United States Patent [19]

Bellan

[11] Patent Number: 4,815,097

[45] Date of Patent: Mar. 21, 1989

[54] METHOD AND APPARATUS FOR STABILIZING ELECTRIC FURNACE ARCS USING AN EXTERNALLY APPLIED MAGNETIC FIELD

[75] Inventor: Paul M. Bellan, Pasadena, Calif.

[73] Assignee: California Institute of Technology, Pasadena, Calif.

[21] Appl. No.: 201,580

[22] Filed: Jun. 2, 1988

[51] Int. Cl.[4] ..... H05B 7/20

[52] U.S. Cl. ..... 373/107

[58] Field of Search ..... 373/108, 107, 102, 90

[56] References Cited

U.S. PATENT DOCUMENTS 4,149,024 4/1979 Stenkvist et al. ..... 373/107

4,495,625 1/1985 Heberlein et al. ..... 373/107

OTHER PUBLICATIONS

THE PHYSICS OF HIGH CURRENT ARCS by Bowman, Jordan and Fitzgerald (The Journal of the Iron and Steel Institute, Jun. 1969, pp. 798–805).

THE EFFECT OF ARC FURNACE ELECTRICAL NOISE AND POWER SYSTEMS by Borrebach (Electric Furnace proceedings, 1975, pp. 217–222).

NOISE REDUCTION AND ELECTRIC ARC FURNACES BY ELECTROTECHNICAL MEANS (Internoise 80 Proceedings, Dec. 1980, pp. 471–474) by Engdahl of the Institute of High Voltage Research, Uppsala, Sweden.

*Primary Examiner*—Roy N. Envall, Jr.

*Attorney, Agent, or Firm*—Leonard Tachner

[57] ABSTRACT

Stabilizing the arc in an electric arc furnace is achieved by using a method and apparatus for applying a magnetic field parallel to the arc between the furnace electrodes. The magnetic field strength applied by the invention should exceed $(h\mu oI)/(2\pi^2a^2)$ where h is the distance between the electrodes, a is the radius of the arc, I is the current between the electrodes and $\mu o$ is the permeability of free space. The magnetic field may be induced by any means not susceptible to the heat of the furnace, such as a coaxially positioned induction coil or by inducing a magnetic field in an open magnetic ring the ends of which form the furnace electrodes.

8 Claims, 2 Drawing Sheets

METHOD AND APPARATUS FOR STABILIZING ELECTRIC FURNACE ARCS USING AN EXTERNALLY APPLIED MAGNETIC FIELD

TECHNICAL FIELD

The present invention relates generally to stabilizing electric furnace arcs and more specifically to a method and apparatus for stabilizing such arcs by using an externally applied magnetic field.

BACKGROUND ART

Electric furnace arcs are in common use today. By way of example, approximately of one third of all of the steel produced in the United States is produced using electric furnace arcs. Unfortunately, without proper measures, such arcs are inherently unstable and such instability produces numerous significant problems One such problem, by way of example is electrical noise on power systems associated with such furnaces. Such noises or disturbances on the electrical system can be detrimental to many different companies or personnel involved in the overall arc furnace system. The arc furnace operator may find it necessary to reduce the power input level below the desired value. The steel company electrical department may be faced with line flashovers or equipment failure due to switching surges. The power company must maintain operation in the face of these disturbances. Other users on the power company lines may be subjected to disturbing light flicker or TV interference due the electrical noise arriving from arc furnace operation. Accordingly, electrical noise is a factor in determining whether a furnace shop installation will be permitted in a certain area and the conditions under which that furnace may operate, indeed to the point of determining whether a furnace installation in a specific area will be an economical success. Other detrimental effects of electric furnace arc instability include a decrease in the heat transfer capabilities of the furnace, a premature deterioration of the arc electrodes and very substantial acoustical noise the volume of which, in some cases, can be so great as to endanger operating personnel.

While the electric arc is a poorly understood phenomenon, it is believed that by stabilizing the arc, the aforementioned detrimental effects of instability can be substantially alleviated or entirely eliminated. There have been a number of attempts in the prior art to stabilize the electric arc, but unfortunately, none of these has proved satisfactory. Thus for example, some stabilization of the arc has been achieved by imposing gas flows in the arc region between the electrodes. Some stabilization has been achieved by altering the geometry of the electrodes such as by making both electrodes hollow or cone-ended. Unfortunately, the use of gas flows is both potentially dangerous to personnel and requires complex and expensive gas control systems. Furthermore, shaping of the electrodes tends to increase their suseptibility to early wear which again results in an expensive remedial attempt.

The following articles have described the detrimental effects of electric furnace arc instability and some of the remedies attempted to stabilize such arcs: "The Physics of High Current Arcs" by Bowman, Jordan and Fitzgerald (the Journal of the Iron and Steel Institute) June, 1969, pages 798–805; "The Effect of Arc Furnace Electrical Noise and Power Systems" by Borrebach from Electric Furnace proceedings, 1975, pages 217–222;

"Noise Reduction and Electric Arc Furnaces by Electrotechnical Means" from Internoise 80 Proceedings, December, 1980, page 471–474 by Engdahl of the Institute of High Voltage Research, Uppsala, Sweden.

There is therefore a current and long-felt need to find a solution to the aforementioned detrimental effects of instability in electric furnace arcs which solution is not only effective in stabilizing the arc, but which is also simple to install and inexpensive to operate.

SUMMARY OF THE INVENTION

The aforementioned long felt need is satisfied by the present invention which provides an apparatus and method for stabilizing electric furnace arc by using an externally applied magentic field. The direction of the magnetic field is parallel to the current flow between the electrodes creating the arc. As used herein, the term "parallel" is intended to encompass parallel and anti-parallel. Two alternative embodiments for achieving such stability using such external magnetic fields ar disclosed herein. One such embodiment comprises the application of a magnetic field provided by an electromagnet and more specifically by a magnetic induction coil which is placed around the arc electrodes in substantial coaxial alignment with the arc. Another such embodiment comprises the use of electrodes which are either made of permanently magnetized materials to produce the required magnetic field direction or form the opposite ends of an open magentic ring which has a coil wound therearound for inducing a magnetic field across the electrode gap. In eithe such embodiment, or in other embodiments which may be conceived as a result of the applicant's disclosure herein, a critical requirement of the present invention is that the magnetic field into which the electric furnace arc is immersed and aligned have a minimum strength which is dependent upon the arc length, the arc radius and the magnitude of the arc current in accordance with the following formula:

$$B_z > (h\mu 0I)/2\pi^2 a^2)$$

It has been found analytically, that by prOviding a magnetic field having a field strength which exceeds $B_z$ in accordance with above noted formula, the inherently produced magnetic forces which result from the effects of a large current arc, can be overcome and trivialized to force the arc to remain stable, thereby alleviating the aforementioned noise and other problems associated with unstable arcs in electric furnaces. The method of the present invention therefore comprises the novel and unique step of applying a magnetic field between the electrodes of an electric furnace arc, being parallel to the current flow between the electrodes and having a field strength which exceeds the aforementioned field strength magnitude which is dependent upon certain parameters of the arc geometry and current.

OBJECTS OF THE INVENTION

It is therefore a principal object of the present invention to provide a method and apparatus for stabilizing electric furnace arcs for alleviating the detrimental effects of an unstable arc such as electrical and acoustical noise, electrode wear and inefficient heating.

It is an additional object of the present invention to overcome certain deleterious effects of an unstable furnace arc by applying a magnetic field between the electrodes producing the arc the magentic field having a direction which is parallel to the current flow between the electrodes and which is of a magnitude which exceeds a specified field strength which is dependent upon the geometrical parameters of the electrodes and the current flow therebetween.

It is still an additional object of the present invention to provide a stabilized electric arc furnace, arc stabilization being achieved by the application of a large magnetic field parallel to the direction of current between the electrodes and having a magnetic field strength which exceeds the value B which is determined in accordance with the following formula:

$$B_z > (h\mu 0I)/2\pi^2 a^2)$$

BRIEF DESCRIPTION OF THE DRAWINGS

The aforementioned objects and advantages of the present invention as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

Figure 1:
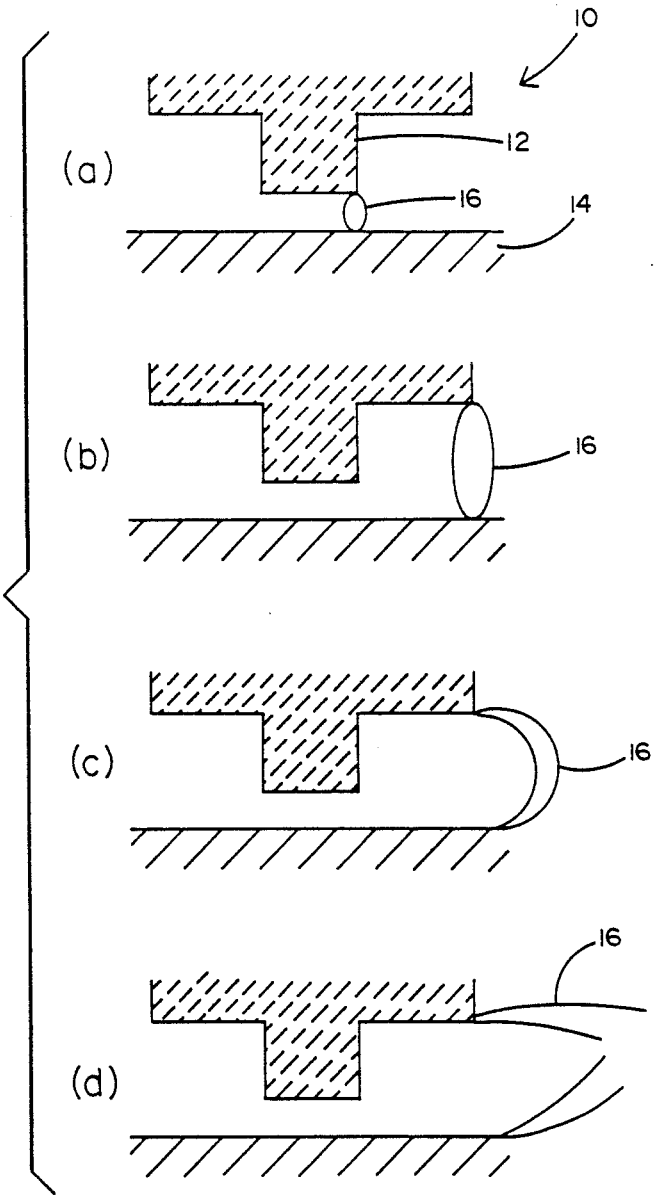
FIG. 1, comprising sub-figures (a)–(d) illustrates the typical behavior of an unstable electric arc.

Referring first to FIG. 1 there is shown therein a sequence of schematic illustrations (a)–(d) of a typical electric arc furnace 10 having a first electrode 12 a second electrode 14 and forming an arc 16 therebetween. Furnaces such as that shown by way of example in FIG. 1, that utilize an electric arc, are used in the steel industry to melt scrap steel so that it can be made into new steel. In the United States about one third of new steel is currently made in this fashion. An arc of up to several hundred thousand Amperes of alternating current is typically drawn between the scrap and a large graphite electrode. The power supply is a transformer connected to the power grid. The sequence of illustrations in FIG. 1 demonstrate typical behavior of the arc over approximately twenty-five microsecond intervals and illustrate that the typical arc is not continuous as may have been previously thought, but rather evolves through a sequence of steps which correlates with the generation of spikes of noise. FIG. 1*a* illustrates that the arc is initially formed between the cathode and anode in the shortest possible path. FIG. 1*b* illustrates that the arc then moves as far to the side of the electrodes as the geometry of the electrodes will allow. FIG. 1*c* illustrates that, subsequently, the arc then bulges to the side and FIG. 1*d* illustrates that finally the bulge increases until the arc is interrupted. This interruption illustrated in FIG. 1*d* yields an enormous change in current per unit time which, because of the associated circuit inductance, results in a voltage spike equal to the inductance times the change in current per unit time.

Without taking the corrective measures of the present invention, the behavior of the electric arc illustrated in FIG. 1 is a substantially unavoidable and inherent instability in the operation of the arc furnace. It is believed that the movement and bulging and eventual interruption of the arc illustrated in FIG. 1 is due to the inherent magnetic effects of the arc itself. Thus, for example, it is not unusual for a return current to flow through a vertical conductor offset from the arc path and to produce a magentic force which causes the arc to move away from the return conductor. Thus, in the example of FIG. 1, the initial movement of the arc demonstrated in FIGs. a and b would result from the magnetic effects of a return conductor to the left of and parallel to the arc path shown in FIG. 1. This magnetically induced movement and eventual bulging shown in FIG. lc inherently further exacerbates the tendency for the arc to be interrupted as shown in FIG. 1 because the bulging geometry of the arc shown in FIG. 1*c* tends to produce a stronger right directed magnetic field than the corresponding left directed magnetic field on the bulged right side of the arc. As the bulge increases and the arc becomes more distorted, the magnetic force differential between the left and right side of the arc grows, thereby further increasing the forces which eventually result in interruption of the arc.

The present invention, which comprises the step of applying a magnetic field of a selected minimum field strength in alignment with the direction of the arc or the current therein, is believed to be effective for the following reason. When the arc starts to bend it must also bend the applied axial magnetic field. However, because the applied field is a vacuum (i.e., lowest energy state) field, it requires energy to bend the applied field. Therefore the bending of the applied field absorbs the free energy so that the free energy is not available for instability. The mathematical analysis of this behavior gives the stability condition to be:

$$kaB_z > B\theta(a)$$

where $2\pi/k$ is the axial wavelength of the mode, a is the arc radius, $B_z$ is the applied axial stabilizing field and $B\theta$ is the azimuthal magnetic field associated with the arc current as measured at a. The worst case for stability is the smallest k, which corresponds to the longest wavelength which can exist in the system The longest possible wavelength corresponds to having the height of the arc equal to half a wavelength so that $h=\pi/k$ or the worst case k is $k=\pi/h$. Because $B\theta$ equals $\mu 0I/2\pi a$, this stability condition can be rewritten as:

$$B_z > (h\mu 0I/2\pi^2 a^2)$$

where h is the height of the arc that is the distance between the two electrodes, I is the current across the electrodes and a is the radius of the arc. Of course, in actual implementation of the axial magnetic field stabilizing characteristics of the present invention, it would be preferable to provide a magnetic field strength which exceeds the aforementioned minimum field strength by a safety factor such as fifty percent to one hundred percent.

Figure 2:
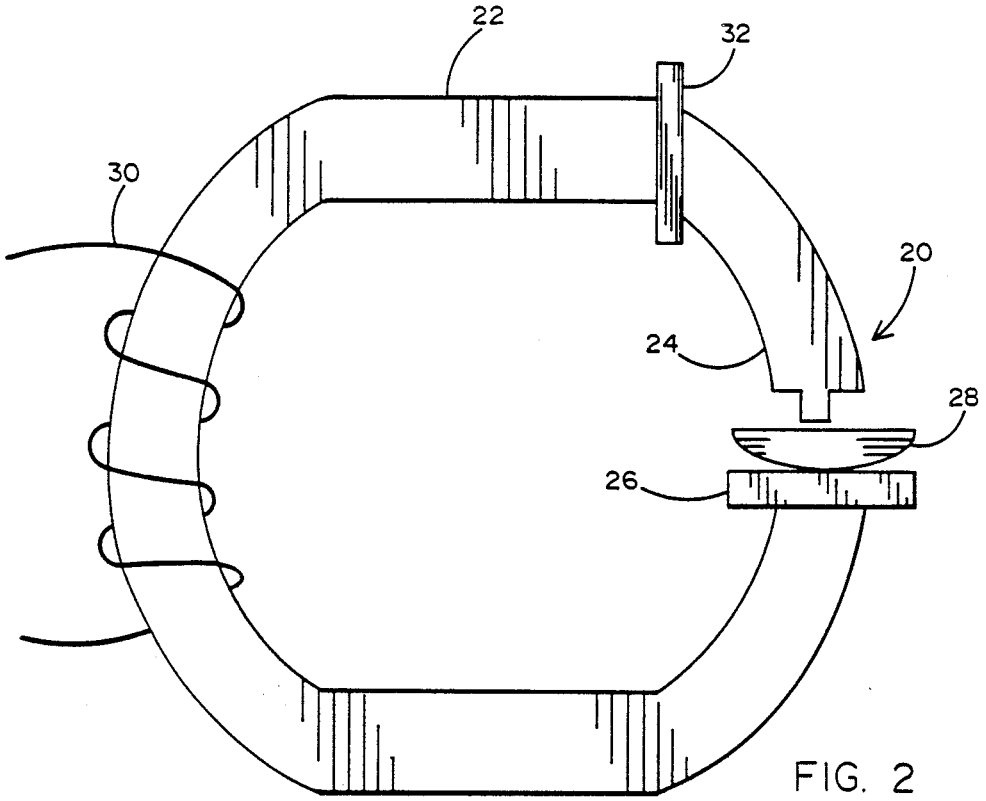
FIG. 2 schematically illustrates a first embodiment of the present invention.
Figure 3:
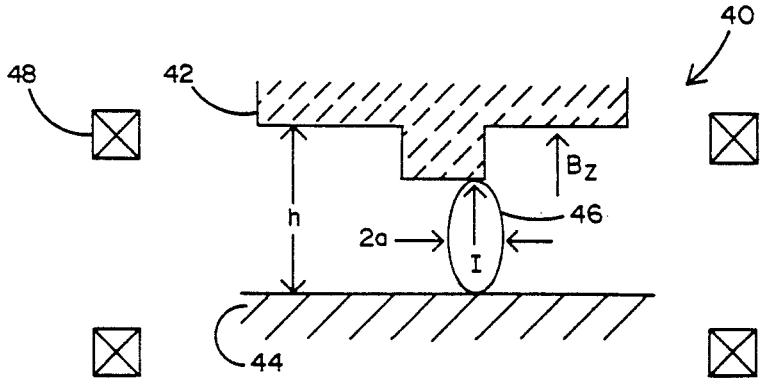
FIG. 3 schematically illustrates a second embodiment of the present invention.

Two alternative embodiments of the apparatus of the present invention are shown in FIGS. 2 and 3, respectively. A first embodiment 20 of the present invention comprises a ring 22 having pair of electrodes 24 and 26 and crucible 28 for receiving the molton metal melted by the arc. A coil 30 is wound around the non-electrode side of ring 22 to induce a magnetic field therein which traverses the ring therewith, thereby creating an axially directed magnetic field across the electrodes 24 and 26. An insulator 32 is provided to interrupt the ring 22 to avoid any electrical shorts between the oppositely polarized electrodes 24 and 26.

A second embodiment 40 of the invention utilizes a magnetic induction coil 48 to provide a magnetic field B between the electrodes 42 and 44 and substantially coaxially aligned with the arc 46. In either embodiment disclosed herein or for that matter in any other embodiment those having ordinary skill in the art will now perceive, the critical parameter is maintaining a magnetic field strength $B_z$ coaxially aligned with the arc and satisfying the following in inequality:

$$B_z > (h\mu 0I)/(2\pi^2 a^2)$$

The method of the present invention comprises the single step of applying an axially directed magnetic field parallel to the arc of an electric arc furnace and having a minimum magnetic field strength exceeding the value corresponding to the inequality noted above.

It will now be understood that what has been disclosed herein comprises an apparatus and method for stabilizing the arc of an electric arc furnace by applying a magnetic field coaxially directed parallel to the direction of the electric arc and having a minimum magnetic field strength which exceeds the following value:

$$h\mu 0I/2\pi^2 a^2$$

where h is the distance between the electrodes of the arc and a is the radius of the arc at its maximum and I is the current between the electrodes producing the arc. Those having skill in the art to which the present invention pertains will now, as a result of the applicant's teaching herein, perceive various modifications and additions which may be made to the present invention. By way of example, alternative means for applying the axially directed magnetic field will now occur to those having the benefit of the teaching herein. In addition it will now be apparent that at least a portion of the current between the electrodes may be used to generate the applied magnetic field. Accordingly, all such modifications and additions are deemed to be within the scope of the invention which is to be limited only by the claims appended hereto.

I claim:

1. In an electric arc furnace of the type having a pair of electrodes spaced apart by a distance h for conducting current of magnitude I therebetween to produce an arc of radius a for generating intense heat; the improvement comprising:

a source of magnetic field disposed relative to said furnace for producing a magnetic field between said electrodes in a direction substantially parallel to said current for stabilizing said arc, said magnetic field having a field strength adjacent said arc which exceeds $h\mu 0I/2\pi^2 a^2$ where $\mu 0$ is the permeability of free space.

2. The improvement recited in claim 1 wherein said magnetic field source comprises an induction coil.

3. The improvement recited in claim 2 wherein said induction coil is positioned coaxially with said electrodes.

4. The improvement recited in claim 2 wherein said induction coil is excited by at least a portion of said current I.

5. The improvement recited in claim 1 wherein said electrodes comprise oppositely facing ends of an open magnetic ring and wherein said magnetic field source comprises an induction coil in intimate relation with said ring for generating a magnetic field therein.

6. A method of stabilizing the arc of an electric arc furnace of the type having a pair of electrodes spaced apart by a distance h for conducting current of magnitude I therebetween to produce an arc of radius a for generating intense heat; the method comprising the step of:

applying a magnetic field between said electrodes in a direction substantially parallel to said current, said magnetic field having a field strength adjacent said arc which exceeds $h\mu 0I/2\pi^2 a^2$ where $\mu 0$ is the permeability of free space.

7. The method recited in claim 6 wherein said applying step comprises th steps of positioning a magnetic induction coil coaxially with said electrodes and causing a current to flow in said coil.

8. The method recited in claim 6 wherein said applying step comprises the steps of forming said electrodes as the oppositely facing ends of a magnetic ring and causing a magnetic field through said ring and across said electrodes.

* * * * *